United States Patent [19]

Beretta et al.

[11] Patent Number: 4,562,441

[45] Date of Patent: Dec. 31, 1985

[54] ORBITAL SPACECRAFT HAVING COMMON MAIN REFLECTOR AND PLURAL FREQUENCY SELECTIVE SUBREFLECTORS

[75] Inventors: Guiliano Beretta, Paris, France; Antonio Saitto, Oegstgeest, Netherlands

[73] Assignee: Agence Spatiale Europeenne-European Space Agency, Paris, France

[21] Appl. No.: 446,610

[22] Filed: Dec. 3, 1982

[30] Foreign Application Priority Data

Dec. 4, 1981 [FR] France ..... 81 22744

[51] Int. Cl.[4] ..... H01Q 1/28

[52] U.S. Cl. ..... 343/781 P; 343/DIG. 2

[58] Field of Search ..... 343/DIG. 2, 753, 754, 343/755, 840, 781 P, 781 CA

[56] References Cited

U.S. PATENT DOCUMENTS

| | | | |
|---|---|---|---|
| 2,636,125 | 4/1953 | Southworth | 343/755 |
| 2,665,383 | 1/1954 | Marie | 343/755 |
| 3,953,858 | 4/1976 | Ohm | 343/779 |
| 4,115,782 | 9/1978 | Han et al. | 343/781 P |

FOREIGN PATENT DOCUMENTS 2112310 6/1972 France .

OTHER PUBLICATIONS

D. H. Staelin "Architectures and Economics for Pervasive Broadband Satellite Networks" pp, 35-4-1, 35-4-7, ICC '79 Conference Record, vol. 2, Jun. 10-14, 1979.

P. Foldes et al. "ISL Tracking Antenna Concepts", pp. 70-5-1, 70-4-4, ICC '81 Conference Record, vol. 4, Jun. 14-18, 1981.

R. Rosenberg "Broadcasting TV Satellite Antenna System" pp. 51-57, Microwave Journal, vol. 24, No. 1.

*Primary Examiner*—Eli Lieberman

*Attorney, Agent, or Firm*—Kenyon & Kenyon

[57] ABSTRACT

The invention relates to multi-mission orbital spacecraft of the kind comprising a platform and several different payloads including several telecommunication antenna feed systems.

The problem is to avoid antenna interference, obtain bigger effective antenna aperture, avoid the necessity for replacing main antennae when replacing payloads, and make maximum use of longer platofrm life.

In accordance with the invention, the antenna system comprises a common primary reflector which is a permanent integral part of the platform while the feed systems are mounted on the payloads, which may be launched separately, and are assembled with the platform to cooperate with the common platform antenna system in operation.

The invention is mainly applicable to multi-mission satellites.

12 Claims, 7 Drawing Figures

ORBITAL SPACECRAFT HAVING COMMON MAIN REFLECTOR AND PLURAL FREQUENCY SELECTIVE SUBREFLECTORS

BACKGROUND OF THE INVENTION

The present invention relates to spacecraft which are suitable for being maintained in orbit, and especially telecommunication satellites, of the kind designed to fulfill several missions, that is to say of the kind comprising a platform and a multiplicity of different payloads including several telecommunication antennas, comprising at least one feed system and a main reflector.

At present, in telecommunication satellite systems multimission payloads, or a multiplicity of different payloads are often integrated on the same platform.

The reasons for this situation are mainly economic. The economic advantage derives from factors such as : standardisation of platforms, re-using common elements of the platform for the different missions, reduction of operational complexity through the control of a single spacecraft, instead of several ones, reduction of the number of launches.

In the future, more capable launchers, such as further developments of the European Ariane family, and the operational use of the Shuttle of the United States of America, complemented by new Orbit-transfer vehicles, will boost the use of geo-orbit larger platforms. Docking techniques in geostationary-orbit will also permit the building-up of larger platforms with standard launchers, and the growth of systems already in orbit with extensive re-use of common elements of the plateform.

With the advent of larger platforms, the use of multimission systems will be further extended.

In the present, and in the projected systems, there are however some problems of technical and system nature.

Thus, firstly, a multimission spacecraft requires a number of different antennas to satisfy the mission coverage requirements of the different payloads operative at different frequencies.

These antennas present problems of mutual mechanical and electrical interference, which will increase with the use of larger antennas in the future.

For this reasons, in the long-term oriented configurations, often, a number of booms are foreseen to separate the different antennas when their size and number are large.

However, this solution to the interference problem presents the draw backs of:

technological problems in the design of the booms.

increase of weight of the platform with a consequent reduction of the advantage of using common platform.

long feeders from the communication electronic units to the antenna systems or long supply lines when the payloads are integrated in the antenna system.

sophisticated control and stabilisation systems due to decentralisation of time-variable masses in the spacecraft structure, when in-orbit maintenance is foreseen.

The second problem resides in the size of multiple antennas. Reflectors may be so large, in the future, to reduce, in relative terms, the economic advantage of a common platform, if every telecommunication mission will need a separate antenna system.

Thirdly, in case of in-orbit maintenance, the operation of substituting a full payload, including the large antenna system, may be cumbersome and with reduced economic advantage.

This point is allied to a final, but maybe the most important consideration which concerns the life-time of the different components of a space segment. Thus in the present system and in all future foreseen systems, the space segment is divided in two parts: payload and platform.

The antenna system is considered as part of the payload. The requirement, so far, has been to increase the life-time of the global space segment. Life-time has been increased from 3, to 5, to 7, and, in the near future, maybe to 10 years. However, this increase of life-time, through future technology improvements, redundancy policy, in-orbit maintenance, and other sophisticated techniques, has a limit. This limit stems from the telecommunication mission life-time.

While an increase of life-time of the platform is always a positive fact, an increase of life-time of the payload, after a certain limit, is useless, thus economically negative. This is due to the variation of service requirements, the necessity to optimize continuously the use of frequency spectrum and orbit, without increasing the complexity of the ground segment. There are exceptions to this rule, but they are limited to time invariant telecom system such as TVBS systems, at the limit of expansion foreseen by the Geneva 1977 Plan. This is not the case in most applications, particularly in the fixed service area. In this area, there is expected a large growth of variable pattern traffic in the future.

These lasf considerations imply the preference for systems with platforms designed to have a long lifetime, while it should be possible to substitute the payloads with more up-to-date versions, after a limited number of years, through docking techniques.

However, this implies the substitution of a part of the space segment of high cost, weight, and volume, if the whole payload (including the reflector system) is substituted.

OBJECT OF THE INVENTION

An object of the invention is to provide a space segment configuration for a telecommunication multimission spacecraft, where some or all of the limitations mentioned in the previous paragraphs are reduced.

SUMMARY OF THE INVENTION

The present invention provides an orbital multimission spacecraft comprising a platform for receiving a plurality of removable and exchangeable payloads operating on different electromagnetic frequency bands including respective telecommunication antenna feed systems, and a telecommunication antenna system comprising a common reflector forming an integral part of said platform for cooperation with said antenna feed systems.

The reflector may be complemented by additional components, in order to perform the common functions for the different missions. The obtained special reflector is named in the following "reflector system", while the other parts of the payload, which include the communication equipments and the feed-system, are named "communication modules".

In this case, it is the reflector system which is permanently mounted on the platform, so as to form an integral part of it.

Preferably, the feed system or communication modules are mounted in the payload in such a way that they can be removed and replaced by use of a servicing spacecraft, such as the Shuttle orbiter or other means.

Due to this arrangement, the special common reflector, (or reflector system) can be reused for different missions of the spacecraft and remain constantly in orbit as a long-life part of the platform. The configuration is applicable both to large future space system, with refurbishing and maintenance through substitution of separate communication modules, or to space segments where the totality of communication modules are integrated in one unit, and the refurbishment is operated through the substitution of the global communication modules. Additionally, even where the feed system or communication modules are not removable nor replacable, the main characteristics of the invention are applicable, for example to smaller satellite systems, where no refurbishment is foreseen, but where it is still taken advantage of the common reflector system, for the different payloads.

Advantages of the proposed solution reside in the fact that for practically all existing or envisaged multimission systems the number of reflector systems is reduced to 1 or 2 (2 for separation between transmission and reception antenna systems). The configuration, very similar to the configuration of a single mission conventional satellite with a single payload, in this latter use is therefore all the more so in the case where solar panels are provided for deployment in a first direction (preferably a North-South direction, which is perpendicular to the orbit) while the two reflectors are deployed in a direction perpendicular to the first (preferably East-West relative to the communication module, which is generally in the orbit direction).

Such a reduction in the number of reflector systems gives a considerable simplification of the structure compared to conventional multi-antenna platforms, and especially in the common case where deployable reflectors are used, whose development is very costly.

The number of launches for all purposes, over the life-time of the system, can be minimized, due to the reduction of the total mass in orbit, maximization of payload density (the reflector system, which is the low-density unit, is launched only once, at the beginning of the mission) and the reduction of the number of servicing flights to the minimum feasible.

The reduction in the number of reflector systems avoids the necessity for using booms to eliminate interference, and this eliminates a number of problems relating to the presence of booms.

As for transmission characteristics, the feedsystem maybe situated in the nearest position to the power amplifiers and low noise receivers. This implies the minimization of losses, which is another significant advantage.

The reflector system, integrated to the platform, can be re-used, even if a reconfiguration of the mission and coverage could be necessary after some years. In this way, there is a maximum of invariant elements that will require a design for long life-time. This will produce the best economical result.

The maintenance and refurbishment of the communication system is simplified by the fact that the large antennae, are deployed only once at the beginning of the life-time of the platform. This should also reduce the risks in the global mission, and in any case reduces the cost of refurbishment.

This solution keeps all the typical advantages of a service satellite concept, where commonly required services are shared among different payloads thereby reducing investment cost and cost of system operations.

In a particularly advantageous embodiment, it can be arranged that the associated components include secondary frequency selection antennae corresponding to different frequency bands, and preferably consisting of dichroic surface elements.

The invention also includes an orbital multimission spacecraft comprising a platform, a plurality of payloads for assembly with said platform and including respective telecommunication antenna feed systems, and a telecommunication antenna system comprising a common reflector forming an integral part of said platform for cooperation with said antenna systems.

DESCRIPTION OF THE DRAWINGS

Other features and advantages of the invention will appear from the following description, given by way of example with reference to the accompanying drawings, in which.

DESCRIPTION OF THE PREFERRED EMBODIMENT

Figure 1:
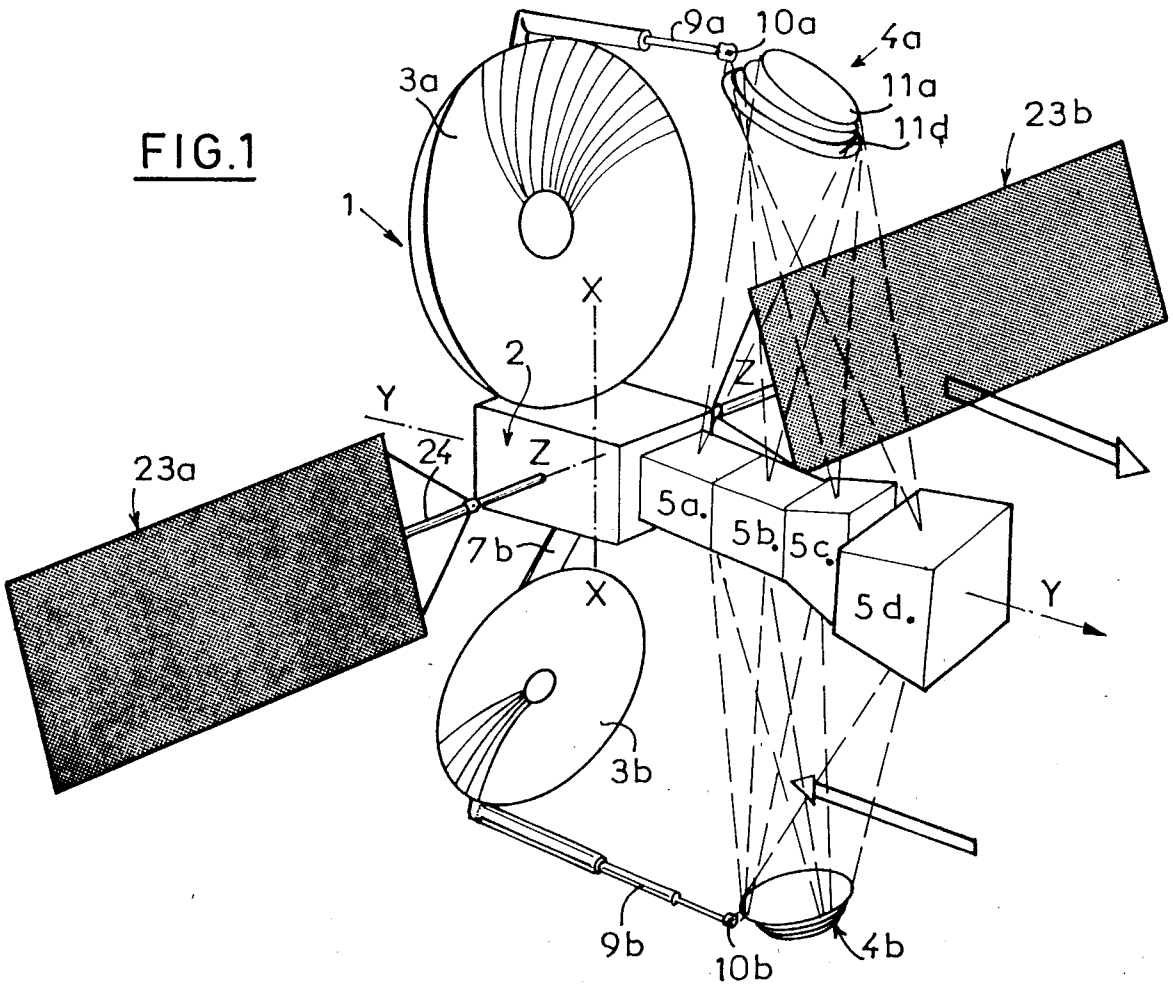
FIG. 1 is a perspective view of a multi-mission spacecraft in accordance with an embodiment of the invention.

The spacecraft shown in FIG. 1 comprises, on one hand a platform 1 comprising a central body 2, two main reflectors 3*a* and 3*b* and two groups of secondary reflectors 4*a* and 4*b*, and on the other hand, payloads comprising two solar panels 23*a* and 23*b* and four communication modules 5*a* to 5*d*.

The shape of the central body 2 is very approximately parallelopiped, and thus defines three orthogonal directions, X—X (corresponding to the orbit on which the spacecraft is placed), Y—Y and Z—Z.

Figure 4:
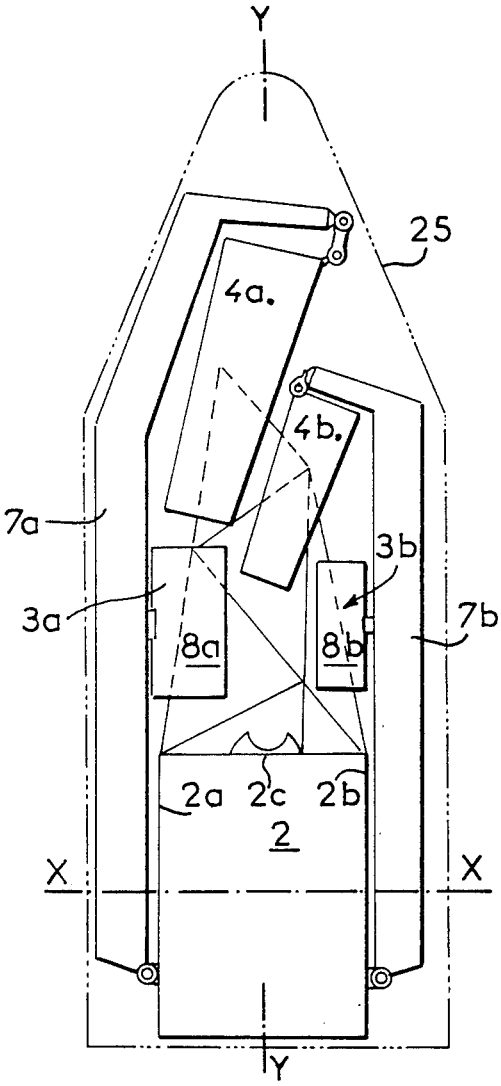
FIG. 4 is a schematic view of the spacecraft of FIG. 1 in launching position.

On its faces directed to X—X, the central body 2 bears two booms 7*a* and 7*b*, connected to the body 2 through two controlled articulations 6*a* and 6*b*, the booms being inclined (in orbit) at angles of the order of 30° to the direction X—X in the plane defined by X—X and Y—Y. Two main reflectors 3*a* and 3*b* are mounted at the centres of the booms 7*a* and 7*b* respectively, the main reflectors comprising dishes of parabolic shape and large diameter. More specifically, these reflectors are of a known deployable type, comprising support ribs which are unwound and a flexible reflecting mesh sheet (FIG. 4 shows the two reflectors 3*a* and 3*b* stowed away within their central housings 8*a* and 8*b*). The main reflector 3*a* is used for transmission and the main reflector 3*b* for reception, and this separation of functions enables them to have different dimensions, the reflector 3*a* having a projected aperture diameter of 7.5 m (suitable for L-band operation) while the reflector 3*b* has a smaller aperture, for example two-thirds. The reflectors are fixed on the booms and orientated so that their axes are in the X—X/Y—Y plane.

At their free ends, the booms 7*a* and 7*b* are bent at 90° and provided with telescopic mechanisms 9*a* and 9*b* at the ends of which secondary reflector groups 4*a* and 4*b* are secured by means of articulations or directional mechanisms 10*a* and 10*b*. The telescopic mechanisms 9*a* and 9*b* enable the secondary reflectors 4*a* and 4*b* to be disposed in suitable positions which are described below, enabling them to cooperate with the communication modules 5*a* to 5*d*, while the directional mechanisms 10*a* and 10*b* are designed to control and regulate their pointing at the different modules.

Each group of secondary reflectors 4*a* or 4*b* comprises the assembly in a stack of four elementary subreflectors 11*a* to 11*d* which cooperate respectively with the modules 5*a* to 5*d*. The sub-reflectors 11*a* to 11*d* are of the rigid, dichroic surface type (each surface may comprise for example a set of inclined crossed resonant dipoles on a dielectric layer, whose transmission and reflection properties vary with frequency, the surface becoming highly reflective, and thus behaving like a solid metallic surface in the vicinity of the dipole resonance frequency). The subreflectors are designed to operate on four different frequency bands, such as L, C, X and K bands. The sub-reflectors are disposed relatively close to each other in the stack, but spaced apart sufficiently to enable individual movement when optimising the individual reflector pointing. Their overall orientation is described below with reference to the communication module description. As for the choice of frequency bands, it is clear that as the main reflectors 3*a* and 3*b* are of L-band size, they can also operate without difficulty in the other three bands.

Figure 2:
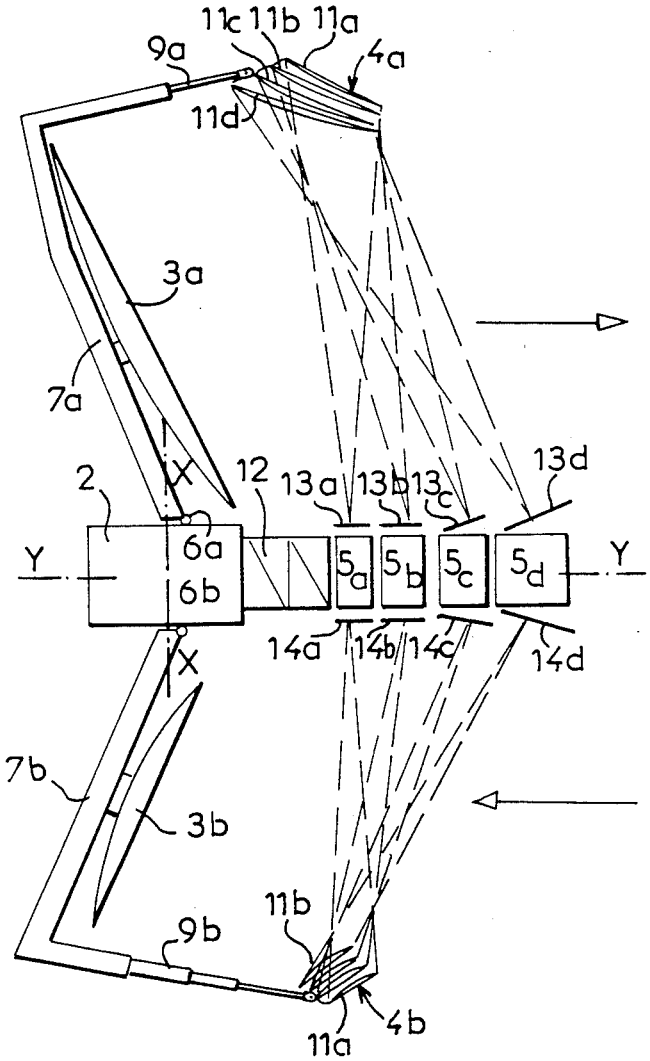
FIG. 2 is a side view of the spacecraft and illustrates particularly the different focal regions associated with the secondary reflectors.

As shown in FIGS. 1 and 2, the communication modules 5*a* to 5*d* are shaped roughly as parallelopiped blocks which are fixed one after the other in the direction Y—Y, the first module being fixed through a support structure 12 on a face of the central body 2 which is in the Y—Y direction on the same side as the secondary reflector group 4*a* and 4*b*, which are disposed roughly opposite the first module 5*a*.

The communication modules 5*a* and 5*d* comprise conventional communication equipment, and also comprise respective feed systems shown schematically at 13*a* to 13*d* on their sides facing the reflector stack 4*a* and at 14*a* to 14*d* on their sides facing the stack 4*b*. The assembly of modules 5*a* to 5*d* with their support structure 12 form part of the spacecraft's payload, and the assembly is mounted removably and interchangeably on the platform, which comprises all the other elements described above. Alternatively, instead of fixing the modules 5*a* to 5*d* one to another, they could be connected in parallel to a common bus (not shown) secured to the same face of the central body 2 as above. This latter arrangement would enable the modules to be replaced separately.

The different feed systems 13*a* to 13*d* (and 14*a* to 14*d*) are thus spread apart in the Y—Y direction, so that they cooperate with the different sub-reflectors 11*a* to 11*d* of the stack 4*a* (or 4*b*).

Figure 3B:
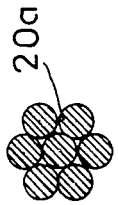
FIGS. 3*a* and 3*b* illustrate feed groups corresponding respectively to full diameter and to reduced diameter operations.
Figure 3A:
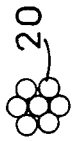
Figure 3:
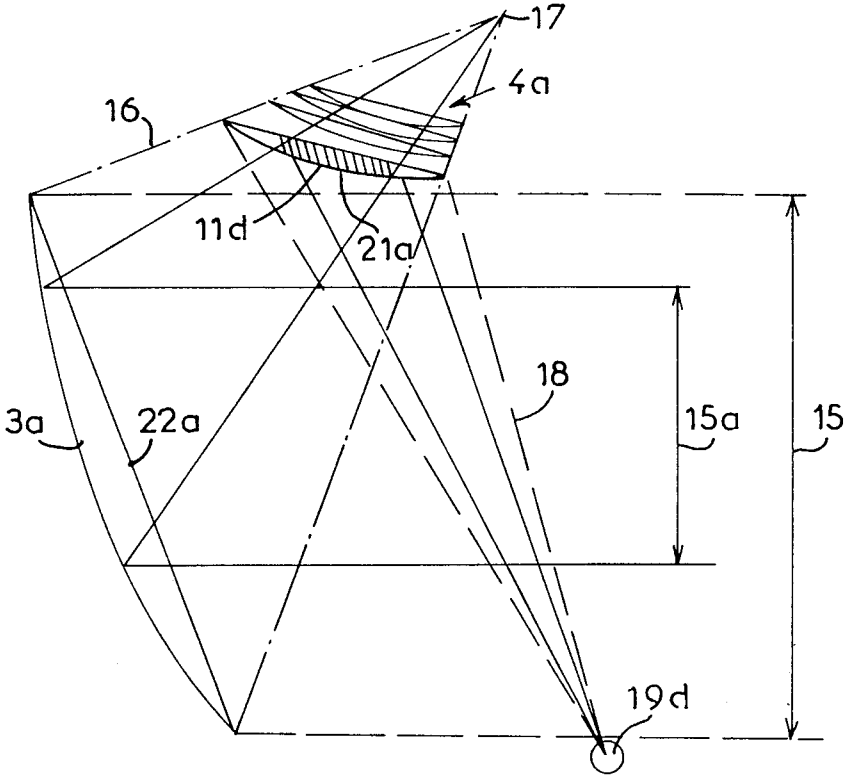
FIG. 3 is a diagram illustrating full diameter and reduced diameter operating patterns.

FIG. 3 illustrates more clearly the operating principle of the antenna system formed by the antenna feeds, of which only the feed 13*d*, associated with the communication module 5*d* has been depicted for reasons of clarity, the secondary reflector groups 4*a*, and one of the main reflectors 3*a*. The secondary reflectors have a primary and secondary focus. The secondary foci coincide substantially with the separate antenna feeds, 13*a* to 13*d*, while the primary foci coincide in an imaginary focal point 17, this point being also the focus of the main reflector 3*a*. In FIG. 3, the divergent beam 18 transmitted by feed 13*d* impinges on secondary reflector 11*d*. Since this reflector reflects radiation in the frequency band transmitted by the feed 13*d*, and is transparent to radiation in the frequency bands transmitted by the feeds 13*a* to 13*c*, the reflector 11*d* reflects the beam emitted by feed 13*d* to the main reflector 3*a*, which again reflects the beam 15, resulting from the incidence of beam 16, from the full aperture of the secondary reflector 11*d*, as if this beam were coming from the main focal point 17. The radiation from the other antenna feeds 13*a* to 13*c* propagates very much in the same way, the main difference being that as a function of the frequency band transmitted, one of the other secondary reflectors reflects the radiation while the remaining are transparent to it.

In other words, the association of each feed 13*a*–13*d* with each of the secondary reflectors in 4*a* is as illustrated in FIG. 2, i.e. feed 13*a* with the first secondary reflector, feed 13*b* with the second secondary reflector, feed 13*c* with the third secondary reflector, and feed 13*d* with the last secondary reflector. The first secondary reflector 11*a* need only be a normal (solid) hyperbolic reflector, and the other reflectors preferably are dichroic hyperbolic reflectors. The reflectors have been arranged in such a way that they cooperate with their respective feeds to allow substantial illumination of the main reflector 3*a* by the respective feeds. This implies that each combination of feed and secondary reflector taken separately should satisfy the optical geometrical conditions for optimal illumination of the main reflector.

As a result, the secondary reflectors are stacked confocally with respect to the main reflector (see FIG. 3), the common primary focus being at 17, whereas they are also stacked in such a way that their secondary foci coincide substantially with the separate antenna feeds.

As regards the realization of the secondary reflector stack, an example is described in the journal "IEEE Transactions on antennas and propagation", in the article "Design of a Dichroic Cassegrain Subreflector", Vol. AP-27 No. 4, July 1979, pp. 466–473.

The secondary reflector group described in this article is limited to a combination of two subreflectors, of which one is of the dichroic type. A person skilled in the art would, however, be capable of realizing the secondary reflector group of the present invention, based on this article, in order to obtain frequency selective focusing, by simply adding further dichroic subreflector surfaces and angling each surface with respect to the other in order to satisfy the optical conditions described above.

According to a preferred embodiment of the invention, the dichroic subreflectors are made of copper dipoles printed on a Kevlar sheet backed with a Kevlar honeycomb supporting structure. See the above article published by IEEE at pp. 470–471, carry-over paragraph. Therefore, the adding of several dichroic subreflector surfaces and the handling of each surface with respect to the other in order to satisfy the optical conditions described above enable obtaining the frequency selective focusing required.

The double reflection described above is of course also obtained in the opposite sense by the reception antenna system on the other side of the spacecraft. It will be understood that the antenna systems operate like an off-axis Cassegrain composite reflector, comprising a primary paraboloid reflector, and a secondary reflector, for example a hyperboloid. The feed at the focus or focal region 19*d* may comprise a conventional horn feed system.

The other sub-reflectors 11*a* to 11*c* of the stack are spaced behind the sub-reflector 11*d* in the direction of the main focus 17, so that their edges are aligned with the extension of the beam 16. These sub-reflectors are inclined at slightly different angles so that the associated foci are situated respectively in the feed systems 13*a* to 13*c*.

It will therefore be understood that the different antenna systems corresponding to the different frequency bands (L, C, X and K) have their own focal regions, which gives them complete independence (due to the fact that different secondary reflector are associated with the different frequencies). It will also be appreciated that the size of each sub-reflector may be reduced, if necessary, by designing suitably the frequency selective surface. Each sub-reflector is associated with a particular frequency, and so the frequency selective surfaces can be designed with a frequency band around the selected frequency, depending on the incidence angle which may vary from 20° to 40°, satisfying typical telecommunication requirements.

The different feed systems 13*a* to 13*d* (or 14*a* to 14*d*) with their associated foci are spaced apart in the Y—Y direction by a minimum spacing enabling the coverage of a reasonably large angular zone on earth. Of course, if the different missions need different coverage zones, a modified spread of the feed systems is possible.

The special positions of the sub-reflector foci allow the minimization of cross polarisation and optimise the off-axis performance, so that this configuration is very suitable for a multiple and countoured beam.

It should be noted that different missions may require different reflector sizes. In order to use the same reflector, a special design of the sub-reflector and feed-system is required: in this way, it is possible to use only that section of the reflector that is needed. It is possible to satisfy this design constraint within a reasonable range of required reflector sizes by only reducing the reflecting diameter of the sub-reflector by about the same percentage as the main one, and using a feed-system which is larger by the same percentage. Considering that the subreflector is a part of the platform, and that it remains fixed for following missions at the same frequency, some freedom to adjust the 3 dB band width (and the mission coverage area) is desirable. This is possible by changing only the feed diameter and introducing the "cluster feed concept" i.e. a cluster of feeds to illuminate in the proper way the subreflector and then the main reflector. Thus, FIG. 3*a* shows schematically a feed cluster pattern 20 whose aperture is the smallest possible and corresponds to usage of the full aperture 15 of the primary reflector 3*a*, while FIG. 3*b* shows a feed cluster pattern 20*a* of maximum aperture corresponding to a reduced aperture 21*a* on the secondary reflector 11*d* and a reduced aperture 22*a* on the primary reflector 3*a*, thus corresponding to an equivalent parallel beam 15*a* directed towards earth and having the desired reduced diameter. Thus, by way of example, a 3.7 m aperture can be used for the main reflector when operating at 20 to 30 GHz for a Teleconference service.

The arrangement described gives a nominal performance for the overall antenna system, comprising feed systems, secondary and primary reflectors, which is very similar to the traditional one, apart from the additional loss of the dichroic subreflector that is anyway reasonably low (less than 0.3 dB).

As shown in FIG. 1, the platform 1 is completed by two solar panels 23*a* and 23*b* which are deployed on opposite sides of the central body 2 in the Z—Z direction and are fixed to the central case by suitable arms 24.

The detailed description above of the transmission primary reflector 3*a* and various associated antenna systems operating at different frequency bands is equally valid for the corresponding antenna systems associated with the reception primary reflector 3*d* disposed on the opposite side of the spacecraft.

Figure 5:
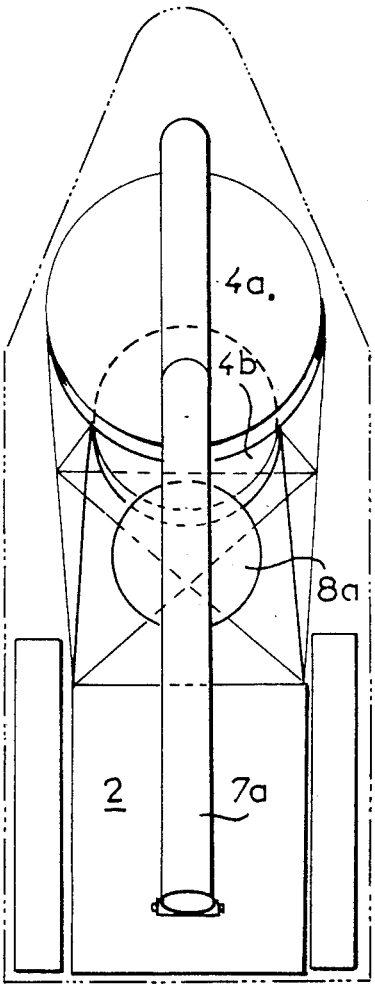
FIG. 5 is a schematic view of the spacecraft taken from the left as seen in FIG. 4.

As shown in FIGS. 4 and 5, the platform 1 is designed specially so as to fold up as an assembly which, apart from the communication modules 5*a* to 5*d* can stow very compactly within the head shell 25 of a Launcher such as the European Launcher project ARIANE IV. The integrated platform 1, comprising the central body 2, the main reflectors 3*a* and 3*b*, the secondary reflector groups 4*a* and 4*b* and the solar panels 23*a* and 23*b* can therefore be put into orbit in a single launch, while the payloads which comprise the communication modules are launched and connected to the platform later.

The positions of the articulations 6*a* and 6*b* of the booms 7*a* and 7*b* on the central body 2, and the diameters of the housings 8*a* and 8*b* of the main reflectors 3*a* and 3*b* when stowed are designed and arranged together so that when the booms 7*a* and 7*b* are folded down to parallel engagement with the faces 2*a* and 2*b* of the central body 2, the housing 8*a* and 8*b* are positioned above the surface 2*c* of the central body which will subsequently receive the payloads. Also the lengths of booms 7*a* and 7*b*, the overall diameter of the secondary reflector stacks 4*a* and 4*b* are also designed and arranged so that the stacks 4*a* and 4*b* stow away inwards against the booms 7*a* and 7*b* in superposition above the housing 3*a* for the larger group 4*a* and partly against the housings 8*a* and 8*b* for the smaller diameter group 4*b*. It will be seen that the stowed size of this assembly is practically limited in the X—X direction to the thickness of the central body 2, plus the thickness of the booms 7*a* and 7*b*, and in the Y—Y direction approximately to the length of the longest support arm 7*a*. The end of the arm 7*a* is also angled so as to mate with the inclined profile of the end of the head shell 25, while the secondary reflector stacks 4*a* and 4*b* are positioned substantially parallel side by side between the two booms.

We claim

1. An orbital multi-mission spacecraft comprising a platform for receiving a plurality of removable and exchangeable payloads, each payload operating on a different electromagnetic frequency band, each payload including a respective telecommunication antenna feed system operating on one of said different frequency bands, and further comprising a telecommunication antenna system comprising a common reflector for all of said different frequency bands, said common reflector forming an integral part of said platform and cooperating with said antenna feed systems so as to receive electromagnetic energy from said feed systems or transmit electromagnetic energy to said feed systems, each of said antenna feed systems illuminating said common reflector by a respective subreflector, said subreflectors comprising a plurality of respective dichroic surfaces for selectively reflecting the frequency band of the corresponding payload and being disposed in a stack with directional adjustment relative to said common reflector and said corresponding feed system, so that each of said subreflectors illuminates said common reflector over its full aperture, said subreflectors having a common secondary focal point.

2. A spacecraft as claimed in claim 1 wherein said sub-reflectors are associated with respective focal regions which are spaced apart in the operational positions of said sub-reflectors.

3. A spacecraft as claimed in claim 1 wherein said common reflector is a deployable reflector, including mounting means for positioning said common reflector angularly relative to said platform, said mounting means including linearly extendable means supporting said secondary reflector means from said platform.

4. A spacecraft as claimed in claim I wherein said common reflector comprises a parabolic dish of size sufficient to cover a plurality of transmission frequency bands.

5. A spacecraft as claimed in claim I wherein at least two of said antenna systems are provided, respectively for transmitting and receiving.

6. An orbital multi-mission spacecraft comprising a platform, a plurality of removable and exchangeable payloads for assembly with said platform, each payload including a respective telecommunication antenna feed system operating on a different electromagnetic frequency band, and further comprising a telecommunication antenna feed system comprising a common reflector for all of said frequency bands, said common reflector forming an integral part of said platform and cooperating with said antenna feed systems so as to receive electromagnetic energy from said feed systems or transmit electromagnetic energy to said feed systems, each of said antenna feed systems illuminating said common reflector by a respective subreflector, said subreflectors comprising a plurality of surfaces for selectively reflecting the frequency band of the corresponding payload and being disposed in a stack with directional adjustment relative to said common reflector and said corresponding feed system, so that each of said subreflectors illuminate said common reflector over its full aperture, said subreflectors having a common secondary focal point.

7. A spacecraft as claimed in claim 6 wherein said payloads comprise respective communication modules for removable assembly to said platform.

8. A spacecraft as claimed in claim 7 wherein said antenna feed systems are arranged for mounting in aligned operational positions.

9. A spacecraft as claimed in claim 8 wherein said payloads are arranged for mounting one to another, and the last payload being arranged for mounting on said platform.

10. A spacecraft as claimed in claim 8 wherein said payloads are arranged for mounting separately on a common support member secured to said platform.

11. A spacecraft as claimed in claims 8, 9 or 10 wherein said common reflector projects from said platform generally at a direction perpendicular to the alignment of said antenna feed systems, said alignment being generally parallel to the transmission axis of the antenna system.

12. A spacecraft as claimed in claim 6, wherein said subreflectors comprise a plurality of respective dichroic surfaces for selectively reflecting the frequency band of the corresponding payload.

* * * * *